US010468833B1

(12) United States Patent
Fusselman

(10) Patent No.: US 10,468,833 B1
(45) Date of Patent: Nov. 5, 2019

(54) OUTLET GROUND PRONG POWER SWITCH AND ADAPTER

(71) Applicant: Henry P. Fusselman, Walnutport, PA (US)

(72) Inventor: Henry P. Fusselman, Walnutport, PA (US)

( * ) Notice: Subject to any disclaimer, the term of this patent is extended or adjusted under 35 U.S.C. 154(b) by 0 days.

(21) Appl. No.: 15/950,151

(22) Filed: Apr. 10, 2018

Related U.S. Application Data

(60) Provisional application No. 62/483,652, filed on Apr. 10, 2017, provisional application No. 62/483,682, filed on Apr. 10, 2017.

(51) Int. Cl.
*H01R 13/66* (2006.01)
*H01R 24/30* (2011.01)
(Continued)

(52) U.S. Cl.
CPC ..... *H01R 13/703* (2013.01); *H01R 13/652* (2013.01); *H01R 13/665* (2013.01);
(Continued)

(58) Field of Classification Search
CPC .. H01R 13/703; H01R 13/665; H01R 13/652; H01R 24/30; H01R 25/006; H01R 2103/00; H01H 1/58; H01H 1/5866
(Continued)

(56) References Cited

U.S. PATENT DOCUMENTS 3,953,689 A * 4/1976 Marrero ..... H01H 1/58 200/51 R
4,419,554 A * 12/1983 Osika ..... H01H 1/58 200/281

(Continued)

*Primary Examiner* — Gary F Paumen
(74) *Attorney, Agent, or Firm* — Clinton H. Wilkinson

(57) ABSTRACT

A ground prong power switch for an electrical receptacle having an open switch position in which current is prevented from flowing to a receptacle outlet and a closed switch position in which current can flow to the outlet, which switch is activated by the insertion or removal of a ground prong of a plug into pin receiving slot of the outlet. A phase conductor is connected directly to a first switch mechanism, and a separate conductor is connected between the switch mechanism and the hot terminal of the receptacle. In a first open switch position a pair of contacts is electrically disconnected and in a second closed switch position the contacts are touching and an electrical current is reinstated to the hot terminal of the receptacle. A tab portion extends into the distal end of the ground prong receiving slot such that upon a ground prong being inserted into the ground prong receiving slot, the tab is contacted and is depressed outwardly causing the switch mechanism to move to the second closed switch position. The tab portion is tapered towards its end, so that items other than a ground prong inserted in the slot will likely deflect to the side of the tab and not activate the switch and close the circuit. Also provided is an electrical adapter plug device configured to enable a two-pronged power cord plug to be used with and energize the safety outlet or receptacle device including a female socket portion configured for receiving the two-prong plug and a three-prong plug portion including an activator pin configured to be received in a grounding pin slot of a socket and further including a mechanism for preventing the two-prong plug from being easily disengaged from the adapter.

18 Claims, 6 Drawing Sheets

(51) Int. Cl.
*H01R 25/00* (2006.01)
*H01R 103/00* (2006.01)
*H01R 13/652* (2006.01)
*H01R 13/703* (2006.01)

(52) U.S. Cl.
CPC ..... *H01R 24/30* (2013.01); *H01R 25/006* (2013.01); *H01R 2103/00* (2013.01)

(58) Field of Classification Search
USPC ..... 200/51 R, 51.09; 439/188
See application file for complete search history.

(56) References Cited

U.S. PATENT DOCUMENTS 4,463,228 A * 7/1984 Osika ..... H01R 13/70 200/43.02
5,047,601 A * 9/1991 Edwards, Jr. ..... H01H 1/58 200/81 R
6,104,105 A * 8/2000 Schaeffeler ..... H01H 9/061 200/522
6,104,586 A * 8/2000 Robinson ..... H01H 83/20 361/102
6,204,747 B1 * 3/2001 Kitchens ..... H01H 37/761 337/407
6,483,061 B1 * 11/2002 Harvey ..... H01H 13/12 200/16 B
6,802,741 B1 * 10/2004 Shatkin ..... H01R 13/7137 200/51 R
6,979,787 B2 * 12/2005 Davies ..... H01H 83/20 200/51 R
7,090,520 B2 * 8/2006 Matsukawa ..... H01R 13/193 200/51.09
7,445,472 B1 * 11/2008 Huang ..... H01R 13/4536 439/138
2001/0012732 A1 * 8/2001 Kitchens ..... H01H 37/761 439/620.31
2002/0104745 A1 * 8/2002 Allison ..... H01R 13/7036 200/51.09
2008/0002339 A1 * 1/2008 Dixon ..... H01H 1/5866 361/673
2008/0108252 A1 * 5/2008 Williams ..... H01H 83/02 439/620.08
2009/0038927 A1 * 2/2009 Guo ..... H01R 13/7035 200/51 R
2009/0075505 A1 * 3/2009 Schneider ..... H01H 1/5866 439/157
2010/0300861 A1 * 12/2010 Heffernan ..... H01R 13/70 200/51 R
2011/0109177 A1 * 5/2011 Crevling, Jr. ..... A47L 5/22 310/71
2015/0270031 A1 * 9/2015 Joo ..... H01R 13/70 200/51 R

* cited by examiner

OUTLET GROUND PRONG POWER SWITCH AND ADAPTER

FIELD OF THE INVENTION

The present invention relates generally to safety devices for electrical receptacle outlets, and more particularly to in an embodiment a ground prong power switch for electrical receptacle outlet devices in which a switch device prevents an electrical current from being supplied to a receptacle unless a ground prong or pin is substantially completely inserted into the ground prong receiving slot of the receptacle.

BACKGROUND OF THE INVENTION

Standard duplex 15 A 125V electrical receptacle outlet devices contain identical sockets or receptacles each having slots configured to receive the blades (also commonly referred to as prongs or pins) of a plug device connected to an electrical appliance or other electrical load, whereby when the blades of the plug device are inserted in the corresponding slots, contact members located along the inner surface of the slots are in an electrical engagement with an outer surface of the blades. Conventionally, current is supplied to a receptacle through electrical wiring connecting between an electrical panel and the outlet, with the phase or "hot" wire or conductor connecting to a "live" terminal by a side terminal screw, push-in, screw-and-clamp, or other connecting system and bringing power to the outlet, while the return or neutral wire or conductor is connected to the neutral terminal via a similar connecting system in order to carry current from the outlet back to the electrical panel. Older NEMA 1-15R (National Electrical Manufacturers Association) non-grounding receptacle devices have positive and neutral contact slots, but lack a ground pin receiving slot, while newer NEMA 5-15R receptacle devices include a third grounding conductor receiving slot. Grounding receptacles are mandatory in most new construction and connect to a separate grounding terminal, and serve as an important additional safety device for the outlet.

In conventional socket-outlets or receptacles, the "hot" wire carrying alternating current (AC) to the outlet is connected so a current is available to the outlet as soon as the hot and neutral prongs of a power cord plug attached to an appliance are inserted in the appropriate slots of a socket or receptacle far enough for the outer surface of the prongs to make and establish an electrical contact with the contact members in the slots. While this arrangement is desirable because as a result power is almost instantaneously available to an appliance when the plug is inserted, a drawback is that the prongs only have to be inserted part-way into the outlet slots before an electrical contact with the forward end of the metal contact members located within the slots is established. The potential exists therefore for a gap to form between the front surface of the outlet and a partially dislodged plug body, in which the exposed plug prongs are live. The plug may slowly loosen over time, or an object might fall on and partially dislodge the plug, both of which could create an electrical hazard. In addition, the finger of a person attempting to plug in a lamp or other load item could accidentally slip between the front face of the outlet and the plug prongs when extended only partway into the outlet causing the person to be shocked and possibly resulting in serious injury or even death.

There is also the well-known danger of a curious young child or other person unwittingly inserting a knife blade or other object directly in the "live" receptacle slot. Since 2013, tamper resistant receptacles (TRRs') having spring-loaded receptacle cover plates which close off the slots in the sockets until an equal pressure such as would be provided by a two-prong plug is applied to both hot and neutral slots at the same time have been required in new residential construction. While TRR's prevent the insertion of small objects in the individual slots particularly by small children, if two objects are inserted simultaneously, this safety feature can be overcome.

In addition to TRR's, many other attempts to reduce the risk of electrical shock from outlets and receptacles have been made, such as providing outlet covers over the outlet openings, or arrangements for more securely holding a cord prong in the outlet. Some outlets used outside of the U.S. have an on/off switch on the front of the outlet that must be manually activated. These devices do not automatically deactivate the outlet when a plug is removed, however, and are likely to be left on, and furthermore can be easily activated by a child. Additional safety measures that will ensure current is prevented from flowing to an outlet when not in use or when the plug becomes even partially dislodged therefore are desirable.

A related hazard is that in order for NEMA 5-15P grounding plugs having two current-carrying terminals or poles and a grounding pin to be connected to older NEMA 1-15R non-grounding receptacle outlet devices having two prong receiving slots but lacking a ground pin receiving slot, electrical plug adapters having a three-pin plug-receiving socket portion and a two-prong outlet connecting portion are commonly used. Such adapter devices also typically include a metal grounding tab which is intended to be connected to an electrical ground, such as a grounded cover or faceplate screw. Such adapter devices also typically include a metal grounding tab which is intended to be connected to an electrical ground, such as a grounded cover or faceplate screw.

Three-prong power cord plugs are mandated on major home appliances such as refrigerators, washing machines, microwave ovens, as well as on power strips and various other devices. Small appliances, however, such as electric shavers, lighting, blenders, crock pots, coffee makers, printers, and other generally portable or semi-portable consumer electronics and appliances, typically only require non-grounded two-prong plugs. Many such plugs are polarized such that the neutral prong is wider than the hot prong and therefore the plug can only be connected in a wall outlet in one orientation, while others that do not distinguish between neutral and line are unpolarized.

As a general rule, Class 1 appliances and devices having a metal-encased power supply require a three-prong power cord plug which ground plug is connected directly to the casing in order to protect users of such appliances from possible electric shock. Thus, if a hot wire in the metal case becomes loose and contacts the case, instead of the case becoming hot, if properly grounded the hot wire electricity is transferred to ground, tripping the breaker box and likely damaging the device but protecting the user from shock. Class II appliances are typically smaller appliances, and either are made of plastic, or include other safety features such as being "double insulated" so there is an extra layer of insulation between the live wire and outside casing in order to mitigate the shock risk. No single fault in a Class II appliance can result in dangerous voltages being exposed such that users can receive an electric shock while handling the device. While Class II appliances may be equipped with a three-prong plug, due to the lower cost and compact size of the two-prong plugs they are usually not provided. Thus, the added protection of a grounding plug is not afforded, and the risk of the plug becoming partially loosened from an outlet as described above remains.

BRIEF SUMMARY OF THE INVENTION

According to some embodiments, there is provided a ground prong relay or power switch mechanism for use with grounding-type receptacle outlets, in which the switch mechanism is arranged to be in an open position in order to break the flow of current to the outlet when a ground pin is not substantially completely inserted in the ground pin receiving slot of the outlet. Current is supplied to the receptacle through conventional electrical wiring connecting between an electrical panel and the receptacle outlet. The phase or "hot" wire or conductor, rather than being connected directly to a "hot" terminal as in a standard receptacle, is connected to an intermediate ground prong relay or power switch mechanism, which in turn is connected to the hot terminal. The switch mechanism is configured to have a first open switch position in which a pair of contacts is separated or disconnected and therefore electrical current is prevented from flowing to the hot terminal of the receptacle, and a second closed switch position in which the contacts are touching and an electrical current is reinstated to the hot terminal of the receptacle. The switch mechanism is configured to be in an open switch position when there is no ground prong or pin in the ground prong receiving slot. In some embodiments, a tab is positioned extending into the distal end of the ground prong receiving slot such that upon a ground prong or pin being substantially completely inserted into the ground prong receiving slot, the tab is contacted by the ground prong and is depressed rearwardly in the ground prong receiving slot, which movement causes the switch mechanism to move to the second closed switch position. The tab is configured to only extend a short distance into the distal end of the ground prong slot so that the switch is not moved to a closed switch position unless a ground prong is substantially or almost completely inserted into the slot. According to some embodiments, an additional feature of the ground prong power switch mechanism is that the tip or end of the tab extending into the ground pin slot is tapered towards its end, so that if an implement such as a conventional pin is inserted in the slot, it will likely deflect to the side of the tab and not move the switch mechanism to the second switch position and close the circuit. Furthermore, in the event that the switch is activated, no shock will be received unless another implement is simultaneously inserted in the "live" receptacle slot. In some embodiments, the switch mechanism includes an electro-mechanical relay, while in other embodiments is a solid state relay. According to some embodiments, the ground prong power switch device is designed for use with any receptacle and when appropriately modified to operate safety depending upon the corresponding current and amperage ratings of particular receptacles, which receptacles may also have different blade dimensions, shapes, and orientations, and may vary by country or region. The ground prong power switch device of the present invention is automatically returned to a non-energized state when the outlet is not in use. Receptacles incorporating the inventor's ground prong power switch device may also be utilized in combination with other safety devices such a tamper resistant receptacles (TRR) in which the positive and neutral slots are closed off unless an equal pressure is applied to the slots at the same time.

Safety electrical receptacles and outlets incorporating the ground prong power switch of the present invention will drastically reduce the likelihood of a child or other person receiving a shock or being electrocuted if a metal object is inserted in the "live" pin receiving slot. In electrical receptacle outlets including the ground prong power switch device of the invention, no current is available to the outlet unless a three-pronged power cord plug is inserted substantially completely into the receptacle. In addition, a partially dislodged plug will not have any power, preventing an object that might inadvertently fall across the exposed positive and neutral plug prongs from creating a hazard, and also providing notice to users of the dislodged plug condition by the lack of power. The ground prong power switch device can be utilized with outlet assemblies configured for conventional household 125 volt 15 or 20-amp receptacles as well as receptacles having different voltage and amperage ratings.

In addition, an electrical adapter plug device configured to be used with safety electrical receptacles and outlets incorporating the ground prong power switch of the present invention is provided. Although Class I appliances having three-prong grounding power cord plugs can be directly used with the present inventor's safety outlet, Class II appliances having two-prong plugs and lacking a grounding pin or prong will not energize the safety outlet upon the two hot and neutral prongs being connected to the socket. The invention therefore also includes an electrical adapter plug containing a female socket portion configured for receiving the two-prong plug, and a three-prong plug portion including a "non-grounding" prong configured to be received in the grounding pin slot of a socket in order to energize the safety outlet or receptacle device. In addition, in some embodiments the electrical adapter plug device includes a locking feature which prevents the two-prong plug from being disengaged from the socket portion of the adapter so that the adapter is not left connected to the safety outlet when it is desired to unplug the appliance from the safety outlet.

Further areas of applicability of the present invention will become apparent from the detailed description provided hereinafter. It should be understood that the detailed description and specific examples, while indicating a preferred embodiment of the invention, are intended for purposes of illustration only and are not intended to limit the scope of the invention. Various embodiments of systems, methods and devices within the scope of the appended claims each may have several aspects, no single one of which is solely responsible for the attributes described herein.

BRIEF DESCRIPTION OF THE DRAWINGS

The present invention will become more fully understood from the detailed description and the accompanying drawings. So that the present disclosure can be understood in greater detail, a more particular description may be had by reference to the features of various embodiments, some of which are illustrated in the appended drawings. The appended drawings, however, merely illustrate the more pertinent features of the present disclosure and are therefore not to be considered limiting, for the description may admit to other effective features.

Figure 1:
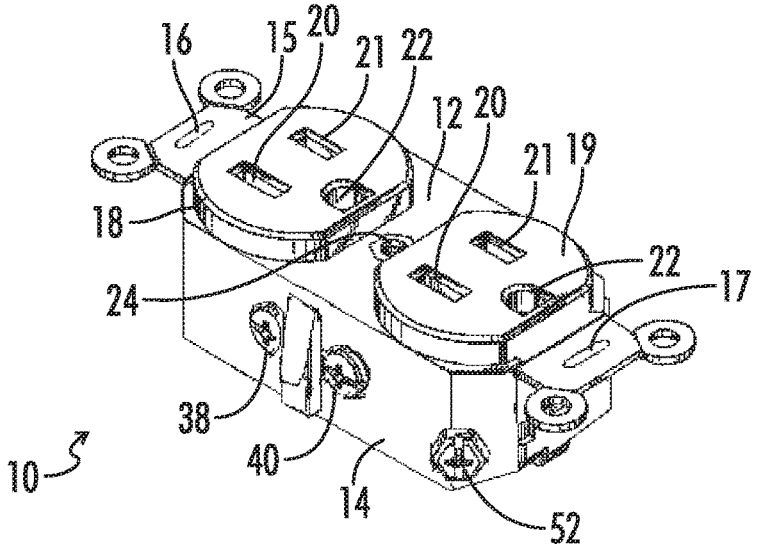
FIG. 1 is a top side perspective view of a 15-amp, 125 volt duplex electrical receptacle outlet configured to incorporate a ground prong power switch device according to the principles of the invention.

In accordance with common practice the various features illustrated in the drawings may not be drawn to scale. Accordingly, the dimensions of the various features may be arbitrarily expanded or reduced for clarity. In addition, some of the drawings may not depict all of the components of a given system, method or device. Finally, like reference numerals may be used to denote like features throughout the specification and figures.

DETAILED DESCRIPTION OF THE INVENTION

The following detailed description is of the best mode or modes of the invention presently contemplated. Such description is not intended to be understood in a limiting sense, but to be a non-limiting example of the invention presented solely for illustration thereof, and by reference to which in connection with the following description and the accompanying drawings one skilled in the art may be advised of the advantages and construction of the invention. Wherever possible, like reference numbers have been utilized to refer to like elements or features of the invention throughout the different embodiments illustrated herein.

Figure 2:
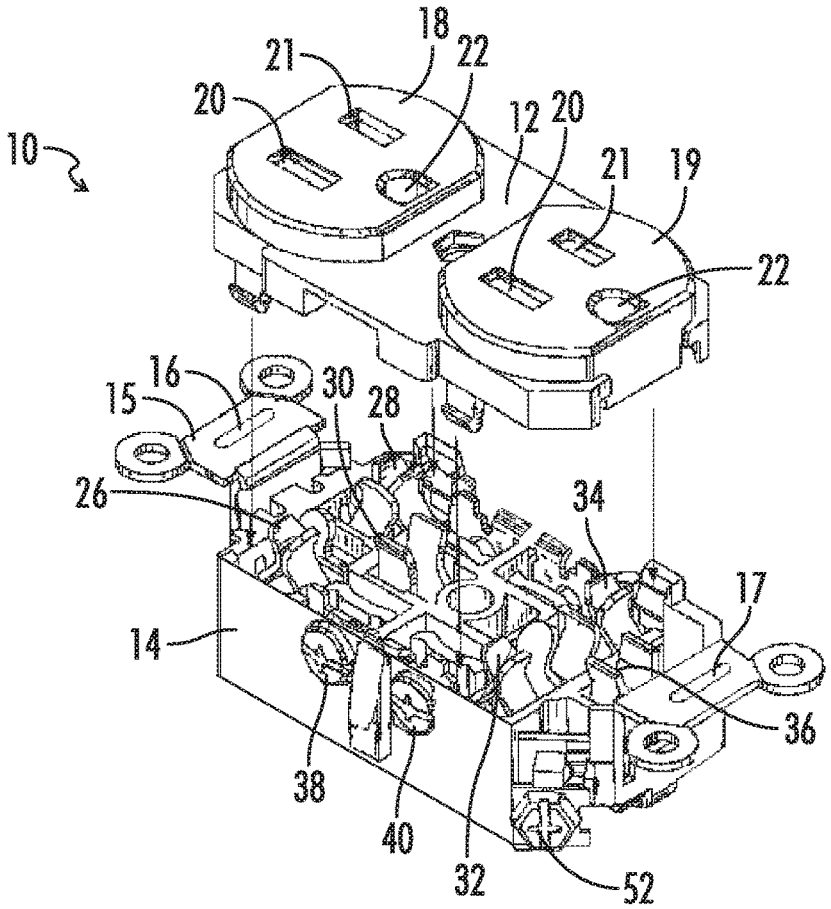
FIG. 2 is a view of the receptacle with the face plate removed.

Referring to FIGS. 1-2, there is shown a receptacle outlet device, indicated generally by reference numeral 10, configured to incorporate a ground prong power switch device or mechanism according to the principles of the invention. Receptacle 10 includes a face plate 12 and a base member or housing 14 which is securable to the face plate 12. A mounting strap 15 (see also FIG. 4) having slots 16 and 17 proportioned for receiving a ground mounting screw enable the receptacle 10 to be mounted to threaded mounting holes of an electrical outlet box (not shown) already secured in an opening in a wall member. Face plate 12 has a pair of plug receiving portions 18 and 19, each including apertures 20, 21 and 22 arranged to receive the neutral, phase or hot, and ground blades or prongs, respectively, of an electrical plug. Also provided in face plate 12 between plug receiving portions 18 and 19 is an aperture 24 for receiving a wall plate mounting screw (not shown).

For ease of fabrication and durability of parts, face plate 12 and base member 14 are preferably constructed of an injection moldable thermo-plastic material, while mounting strap 15 is made of steel or another suitable material. Any injection moldable thermo-plastic material acceptable for use in electrical wiring devices can be used, provided it satisfies the necessary flame, impact and other electrical and mechanical property tests required by Underwriters Laboratories or any other applicable code. Examples of such acceptable materials include polyvinyl chloride, polycarbonates, nylon, etc., and/or blends of such materials which are formulated for good impact strength, good molding characteristics and low cost.

Figure 3:
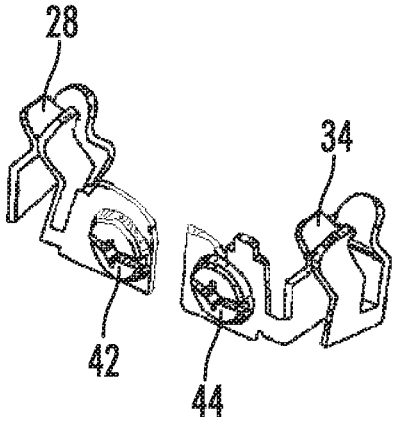
FIG. 3 illustrates the separated positive or "hot" terminals for the receptacle.

Base member 14, shown with face plate 12 removed in FIG. 2, is formed with a plurality of interior chambers or compartments defined by separating walls formed of an insulative material within which the electrical contact members for receiving the prongs of a plug are received and contained. Housing 14 also includes one or more slots, notches, tabs, and the like for holding other components of the receptacle outlet assembly as needed, which for present purposes are considered to be of a conventional configuration. More particularly, neutral electrical contacts 26, phase or hot contacts 28 and ground contacts 30 for plug receiving portion 18 are secured in separate insulated chambers in base member 14. For outlet plug receiving portion 19, neutral electrical contacts 32, phase or hot contacts 34 and ground contacts 36 are similarly provided. Neutral contacts 26 and 32 are connected to screw terminals 38 and 40, and phase or hot contacts 28 and 34 are similarly connected to screw terminals 42 and 44, respectively (see FIGS. 3 and 5). All of the electrical contacts are formed of an electrically conductive material such as metal. While in conventional duplex receptacles, the phase or hot screw terminals 42 and 44 are typically provided as a single terminal including a bridge portion which electrically connects between screw terminals, as shown in FIG. 3, in safety receptacle 10 hot screw terminals 42 and 44 are electrically isolated from each other either by removing the bridge portion or are formed separately. Neutral screw terminals 38 and 40 may be electrically connected in receptacle embodiments including the ground prong power switch mechanism of the present invention.

Figure 4:
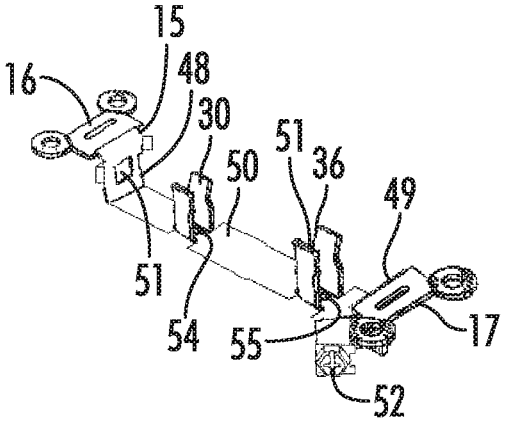
FIG. 4 illustrates the mounting strap for the receptacle.

FIG. 4 illustrates mounting strap 15 disassembled from base portion 14 of receptable 10 and includes side legs 48 and 49 and bottom leg 50. Mounting strap 15 may be coupled to base member 14 by projections on the base which engage with openings 51 on the side legs 48 and 49 of the strap 15. Spaced apart ground contacts 30 and 36 are supported on bottom leg 50 of strap 15, and when strap 15 is assembled with base member 14 as indicated above contacts 30 and 36 are located in separate insulated chambers in the base member 14. Terminal screw 52 on mounting strap 15 provides a location for connecting a ground conductor to the mounting strap to provide a ground connection for the ground contacts 30 and 36. In addition, mounting strap 15 has been modified to include apertures 54 and 55 located in the bottom leg 50 of mounting strap 15 at a position between ground contacts 30 and 36, respectively.

Figure 5:
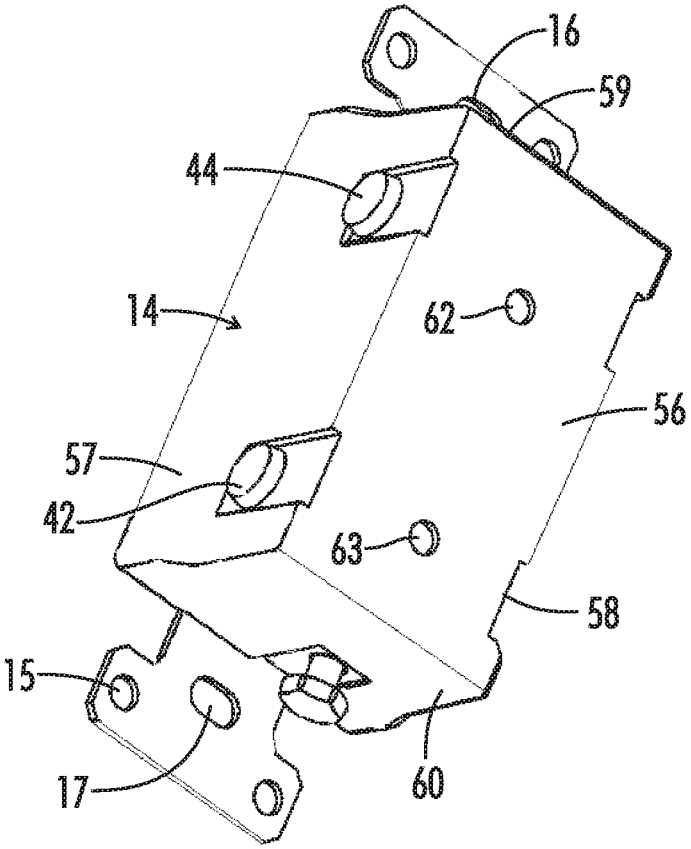
FIG. 5 is an isometric view from the rear of another receptacle base configured for use with the present invention.

FIG. 5 illustrates the rear surface of a base member 14 including a rear wall 56, a pair of oppositely disposed side walls 57 and 58, and a pair of oppositely disposed end walls 59 and 60. Apertures 62 and 63 in rear wall 56 are located so that they are aligned with apertures 54 and 55 in bottom leg 50 of mounting strap 15 when the mounting strap 15 is secured in the base portion 14. As will be explained with reference to FIG. 10, pairs of apertures 54-55 and 62-63 shown in FIGS. 4 and 5 are positioned and dimensioned to allow the plastic tab of the ground prong switch mechanism 70 to extend into the distal end of ground prong receiving slots 22 of the plug receiving portions 18 and 19.

Figure 6:
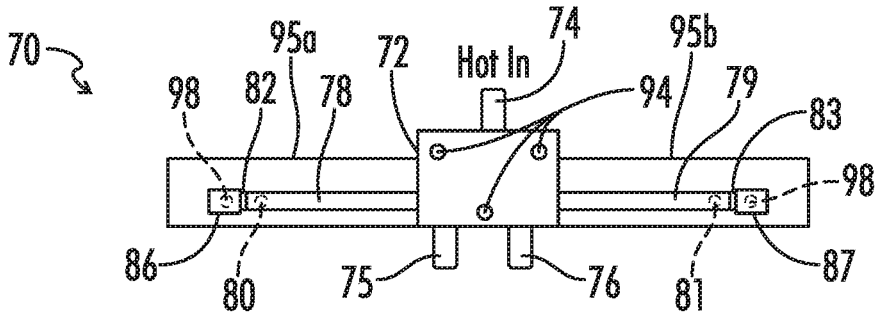
FIG. 6 is a top view of a ground prong power switch mechanism in accordance with the invention.
Figure 7:
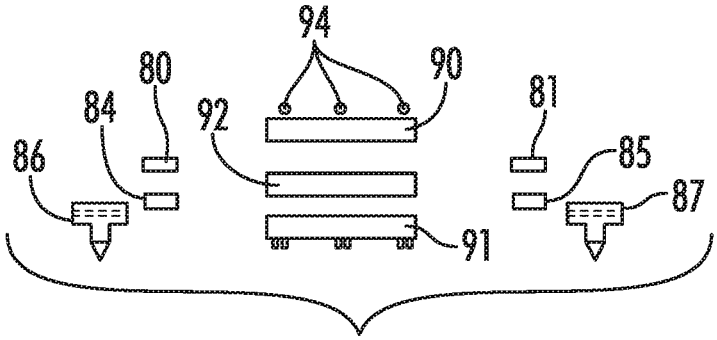
FIG. 7 is a diagrammatic side view of the primary components of the switch mechanism.
Figure 8:
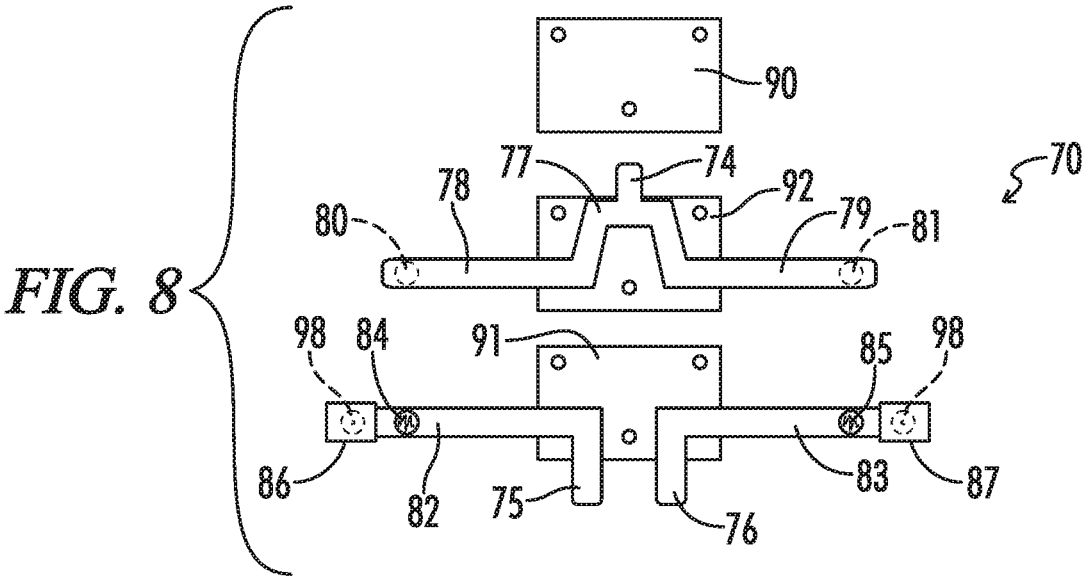
FIG. 8 is another diagrammatic view of the switch mechanism components.

Further details of an embodiment of a ground prong power switch 70 mechanism in accordance with the present invention are illustrated in FIGS. 6-10. Switch mechanism 70 includes a housing 72 that in the illustrated embodiment is mounted by suitable fasteners in FIG. 10 to rear wall 56 of base member 14. While in a standard receptacle, the incoming "hot" wire is normally connected directly to one or both of the "hot" terminal assemblies by mounting screws 42 and 44 (or by an alternative different conventional direct connection arrangement), in safety receptacle 10, the "hot" wire 103 (FIG. 10) will be connected to "hot in" terminal 74 of switch mechanism 70, such that switch mechanism 70 is therefore electrically interposed between the "hot" wire and the "hot" connection to receptacle 10. Switch mechanism 70 also includes first and second phase or "hot out" terminals 75 and 76, which are connected by separate wires 104 and 106 (FIG. 10) to the receptacle in a conventional manner such as to standard "hot" terminal screws 42 and 44, respectively. As illustrated in FIG. 8, a conductor 77 made of a suitable piece of an electrically conductive material such as brass or copper is connected to "hot in" terminal 74. Conductor 77 may be a U-shaped flat metal strip having a first branch 78 and a second branch 79 extending in opposite directions, with contacts 80 and 81 connected to conductor 77 on the outer ends of branches 78 and 79, respectively, or in another embodiment may be a straight metal strip or other shape rather than a U-shape. In addition, an L-shaped conductor 82 also formed of a suitable piece of an electrically conductive material is provided in housing 72 of switch mechanism 70 and includes an elongated section which is aligned with branch 78 of conductor 77. Similarly, another L-shaped conductor 83 is positioned in housing 72 having an elongated section in alignment with branch 79 of conductor 77. More particularly, conductors 82 and 83 are made of a flexible metal such as brass or copper, and contacts 84 and 85 are connected to conductors 82 and 83, respectively, in alignment with contacts 80 and 81 of conductor 77. Contacts 80-81 and 84-85 are preferably formed of a highly electrically conductive material such as silver or gold alloy metals, or another material having a high wear resistance and oxidation resistance.

As best shown in FIGS. 6 and 7, housing 72 of switch mechanism 70 has top and bottom insulating sections 90 and 91, and an intermediate insulating section 92. Conductor 77 is mounted extending between top and intermediate sections 90 and 92, and conductors 82 and 83 are mounted extending between intermediate section 92 and bottom section 91. Top, bottom, and intermediate sections 90, 91, and 92 are secured together by rivets 94 or other suitable fasteners. In the illustrated embodiment, the ends of branches 78 and 79 of conductor 77 and of flexible conductors 82 and 83 extend out of housing 72 and are provided with separate covers 95*a* and 95*b*, shown in FIG. 6.

Figure 9:
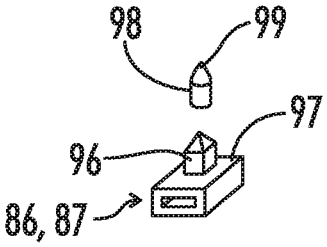
FIG. 9 illustrates the plastic point components of the switch mechanism.

Push points 86 and 87 are mounted near the ends of conductors 82 and 83 in close proximity to contacts 84 and 85, respectively. As best shown in FIGS. 7 and 9, push points 86, 87 each include a sleeve section 97 having a longitudinal slot therein in which the ends of conductors 82 and 83 are slidingly received and secured in a desired position. Push points 86, 87 also have shaft section 96 which extends outwardly from a side surface of sleeve section 97, which shaft section 96 has a support section 98 and a tip section 99. Shaft section 96 in one embodiment has a rounded shape but in other embodiments may be differently shaped, while tip section 99 preferably has a conical or pyramidical shape. The closed outer end of standard ground prongs will press against tip section 99 when inserted in a receptacle ground prong slot. Some ground prongs are known to have an open or U-shaped outer end, and tip section preferably has a pointed end which will extend into the open outer end of the ground prong when plugged into the ground prong slot, which ensures that the shaft section will be engaged with the ground prong as discussed below. Shaft section 96 may have other suitable configurations for tip section 99 depending upon the type of plug being utilized and the amperage and voltage ratings of the receptacle. The ground prong is also normally longer than the live and neutral plug blades, so that it is the first prong to connect and the last to disconnect from the receptacle, thereby ensuring that the plug is connected to earth before any live connections are made. In addition, the grounding plug is thicker so it has a lesser resistance and is suitable for carrying a fault current.

Shaft section 96 is facing in an opposite direction from conductor legs 78 and 79, so that when switch mechanism 70 is secured to rear wall 56 of the base member 14 the mechanism is configured such that tip section 99 will extend into the distal end of the ground prong receiving slot 22 of the safety receptacle 10. More particularly, as shown in FIG. 10, shaft 96 is configured to extend through apertures 62 and 63 in the rear wall 56 of base member 14, and also through apertures 54 and 55 in mounting strap 15, such that the tip 9 of the push points or tab members 86 and 87 is positioned in the end of ground prong slots 22 of plug receiving sections 18 and 19.

Figure 10:
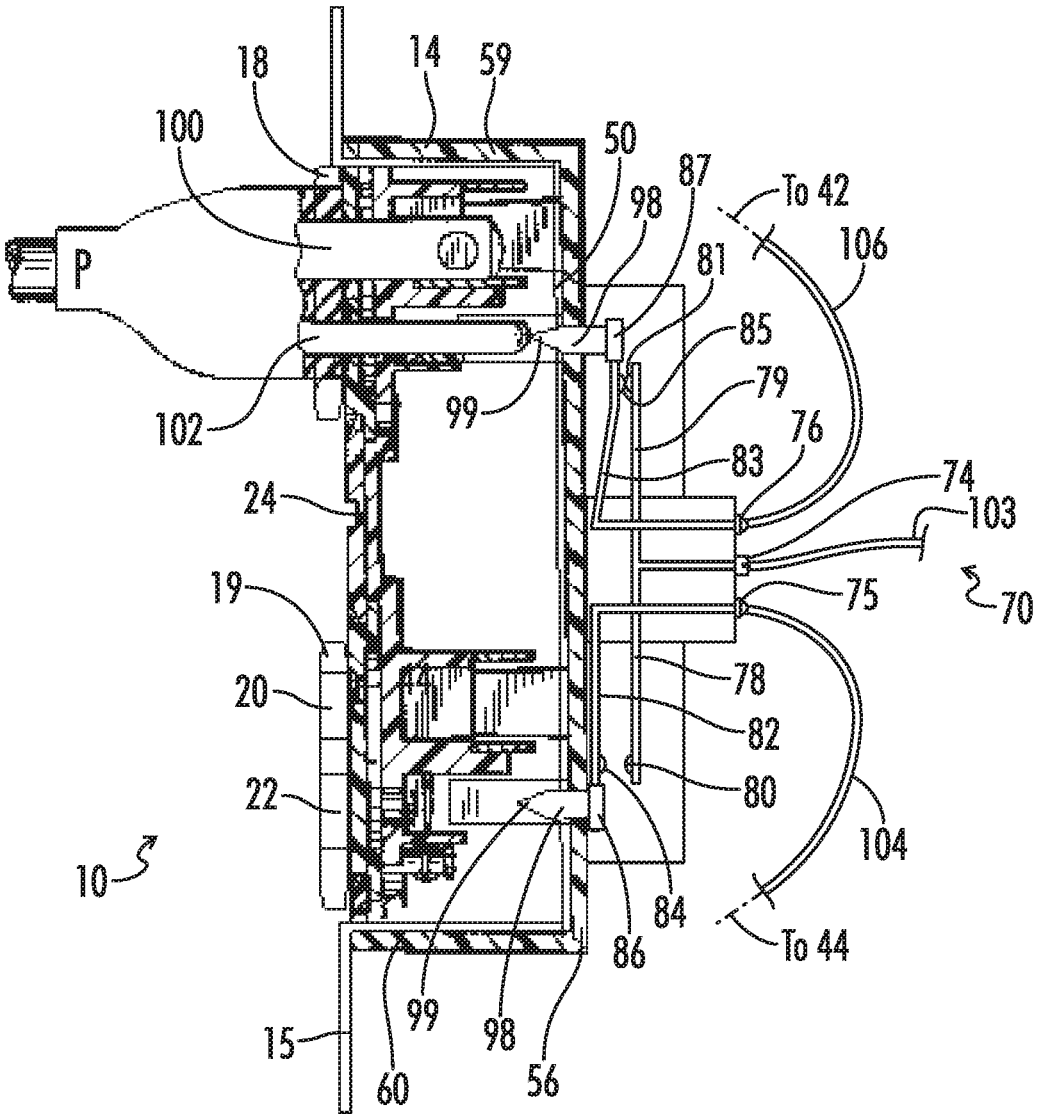
FIG. 10 is an elevation side sectional view of a receptacle incorporating an embodiment of the ground prong power switch mechanism of the invention.

FIG. 10 illustrates the safety receptacle 10 and ground prong power switch mechanism 70 with a grounding plug P inserted in plug receiving portion 18, and with no plug inserted in plug receiving portion 19. Referring first to plug receiving portion 19, shaft section 96 of plastic point 86 extends through aperture 63 (FIG. 5) in the rear wall 56 of base member 14 and aperture 55 in mounting strap 15, and extends into the rear or distal end of ground prong receiving slot 22 of portion 19. The switch is in an open position, since contact 80 on conductor 78 which is connected to "hot in" terminal 74 is not touching contact 84 on switch conductor 82, but rather there is a gap between the contacts which is filled with air which acts as an insulating medium between the contacts. Such gap should be wide enough to prevent arcing between the contacts. However, as illustrated plug P is completely inserted in plug receiving portion 18, with "hot" blade 100 and ground blade 102 being shown. In particular, the inner end of ground blade 102 is pressing against the tip 99 of plastic point 87, which causes tip 99 and plastic point 87 to be forcibly pushed rearwardly in ground prong slot 22. The force of blade 102 against plastic point 87 causes metal conductor 83 to flex or bend towards conductor 79, until contacts 81 and 85 are pressed together and are in electrical contact. In this position, the switch mechanism is now in a second closed position, such that current from conductor 79 is now able to flow through conductor 83 and then through "hot out" terminal 76 and through wire 106 to "hot" terminal 42 of the receptacle 10. When plug P is removed, flexible conductor 83 will then flex back to its original position, such that shaft section 96 and tip 99 of plastic point 87 is again extending further into the ground prong receiving slot 22.

It will be understood that when a ground plug prong or other suitable pin is inserted into slot 22 of the plug receiving portion 18, 19, of receptacle 10, when almost or substantially completely inserted, the outer end of the ground prong will come into contact with tip 99 and exert an outward force on the tip. In an embodiment, tip 99 extends into the distal end of the ground blade receiving slot between about 2 mm and 4 mm, although this distance may vary depending upon the particular type of receptacle utilizing the ground prong power switch device of the present invention. When a plug is substantially completely or completely inserted, the inward force of the ground prong against the tip 99 of push point 86, 87 is transmitted to flexible conductor 82, 83, which in turn flexes inwardly towards conductor 78, 79. When the ground prong is completely inserted in slot 22, contact 84, 85 on conductor 82, 83 is pressed and held in physical contact with contact 80, 81 of conductor branch 78, 79 respectively. Such contact establishes an electrical connection from "hot" power terminal 74 of switch mechanism 70, through connector branch 78, 79 of conductor 77 to conductor 82, 83, to terminal 75, 76 and then through the conduit 104, 106 connecting between terminal 75, 76 and conventional "hot" terminal 42, 44 of the safety receptacle 10. When the ground prong is removed from the plug receiving portion, conductor 82, 83 will automatically move back to a normal unflexed position, breaking the contact between contact 84, 85 of conductor 82, 83 and contact 80, 81 of conductor branch 78, 79, and allowing plastic point 86, 87 to extend into the distal end of the ground prong slot 22.

In a preferred embodiment, switch device 70 is mounted to the rear surface 56 of the receptable housing 14 in order to isolate the switch mechanism from the inner components of the receptacle, and in order to keep the flow of electricity completely outside of the housing unless the ground prong switch has been activated. In other embodiments, however, the ground prong power switch 70 may be mounted in an electrical outlet box generally in the usual way by inserting the device mounting screws through apertures 16 and 17 in the mounting strap and corresponding apertures in the outbox. Where the safety receptacle is used to replace an existing receptacle, depending upon the size of the original outlet box, a new outlet box having an extra capacity may be required to accommodate the somewhat larger safety receptacle due to the additional switch mechanism. However, the safety receptacle or outlet device 10 will easily fit in most existing electrical boxes arranged to receive standard sized outlets, which typically have a width of about 2.25 inches, a height of about 3.75 inches, and a depth of between about 2.875 inches and 3.5 inches.

Figure 11:
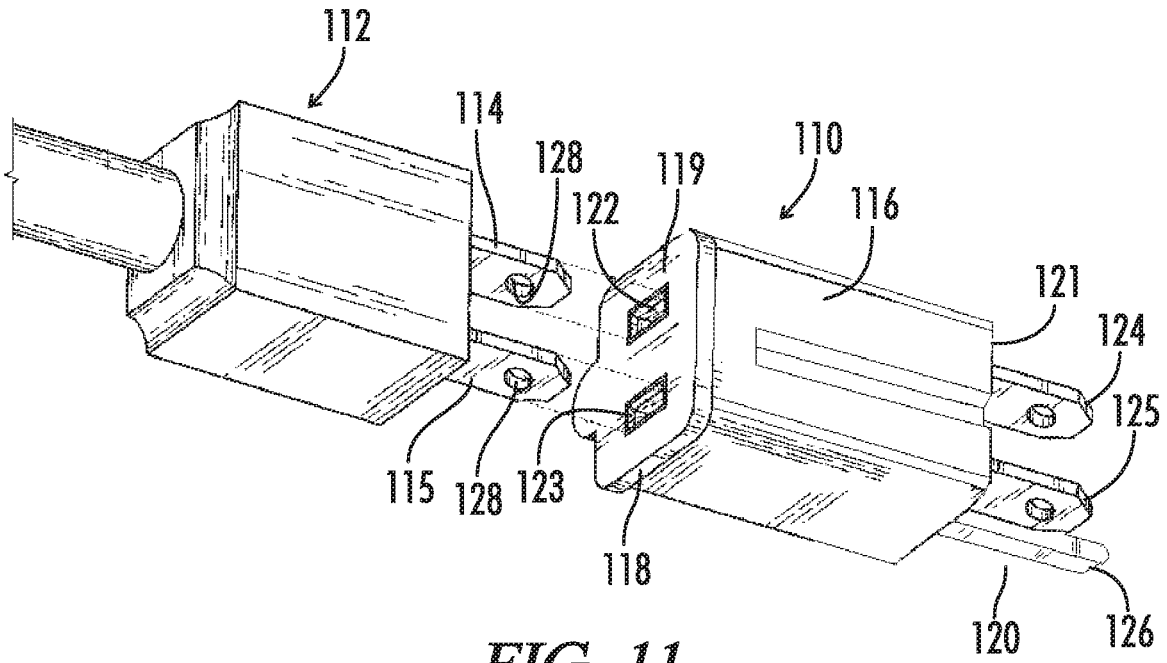
FIG. 11 is an isometric view of a two-prong to three-prong electrical adapter plug device constructed in accordance with the present invention.

FIG. 11 illustrates an adapter plug device 110 accompanied by a conventional power cord plug 112 for an electrical appliance or device. Plug 112 has a pair of prongs or blades 114 and 115 adapted to be connected to a source of electrical potential, such as the female contacts of a conventional household two-prong or three-prong wall outlet configured to supply electricity to an appliance or device. Plug 112 will operate in a conventional three-prong outlet even though the grounding pin slot of the socket is left empty. However, in the just-described ground prong safety outlet, a pin or prong must be inserted in the grounding pin slot in combination with the neutral and hot pins in order for the safety outlet or receptacle to be electrically energized. Two-prong plug 112 can be conveniently used with the safety outlet or receptacle, however, if a pin or other blade member is inserted in the socket female grounding pin receiving slot in order to activate the safety receptacle. A plug having such an additional activator pin is therefore provided for in adapter plug 110. Adapter plug 110 has a body or housing 116 made of a suitable dielectric material, such as ABS plastic, and generally includes a female socket or two-prong plug-receiving portion 118 along end surface 119 and a three-prong male plug portion 120 located along opposite end surface 121. Socket portion 118 includes a pair of plug blade receiving slots 122 and 123 which are compatible with and adapted for receiving parallel blades 114 and 115 of plug 112. While in the illustrated embodiment socket portion 118 is not shown as being polarized, in another embodiment slot 122 will be elongated or taller to receive a taller neutral blade of a polarized plug.

Plug portion 120 of adapter 110 has a neutral blade 124, a "hot" blade 125, and an activator blade or pin 126. Activator blade 126 is sized and dimensioned to be inserted in the ground blade receiving slot of a receptacle. More particularly, activator blade 126 is positioned to make contact with a safety switch device provided along an inner wall of the grounding pin slot of the present inventor's safety outlet. Blade 126 is non-grounding and does not require a separate earth ground, since appliances having a two-prong plug are double-insulated or include other safety features. Blade 126 therefore may be made of a variety of different materials including metal or plastic, and should be sufficiently strong and rigid to be in accordance with NEMA and any other connector cord regulations. The tip of activator blade 126 may also be shaped or dimensioned to provide the best contact with the safety switch feature of the safety outlet or receptacle device, and preferably has a closed forward end. Activator blade 126 extends outwardly from end surface 121 further than blades 124 and 125 in the same manner as a conventional ground pin or blade of a three-prong plug is longer so that the ground pin makes electrical contact first, grounding the device before power is directed to the appliance or device. Use of a longer activator blade 126 therefore will cause the safety switch in the safety outlet to be activated before the neutral and hot blades make electrical contact, so that there is no delay in power being directed to the appliance or device during use of the safety outlet of the present invention.

Figure 12:
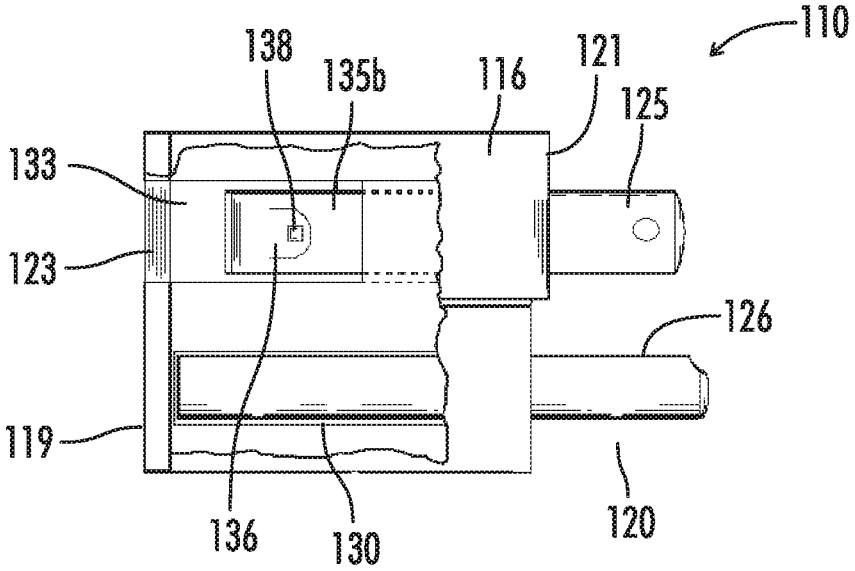
FIG. 12 is a partial sectional view of the adapter plug device shown in FIG. 11.
Figure 13:
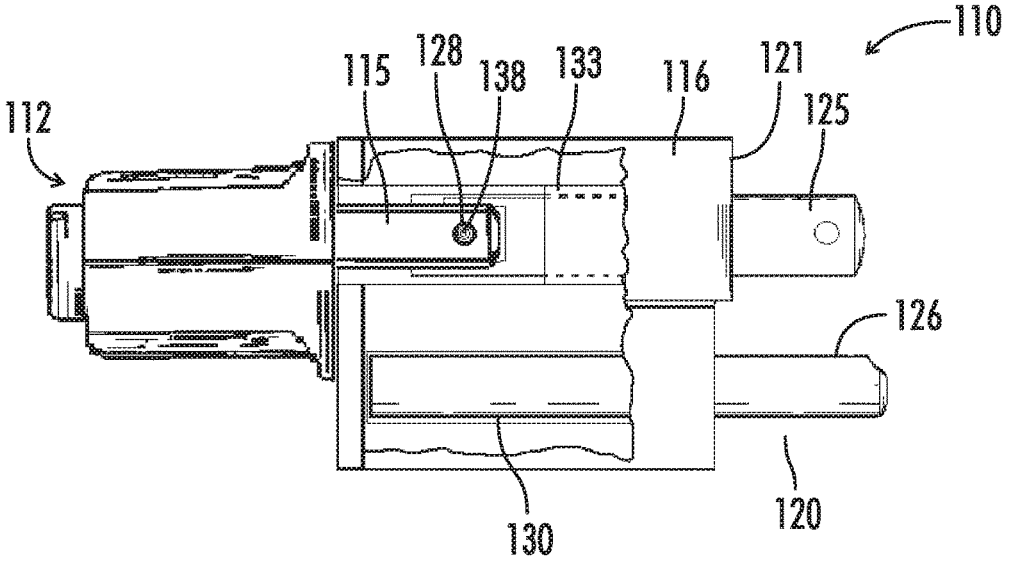
FIG. 13 is a partial sectional view as in FIG. 12 operatively associated with a male plug.
Figure 14:
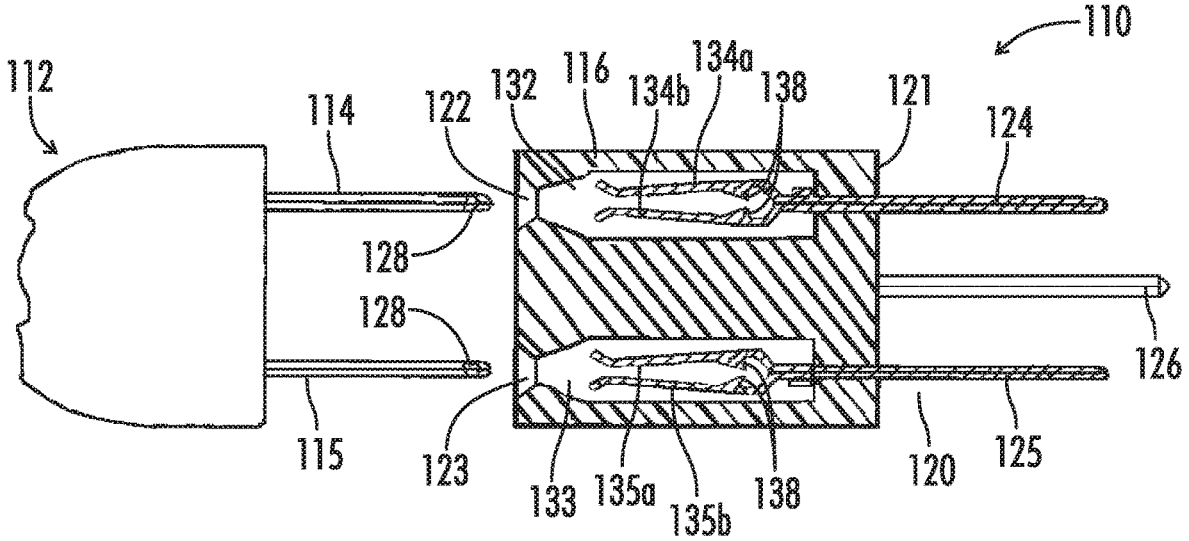
FIG. 14 is a partial transverse sectional view of the adapter plug device.

Prongs or blades 114 and 115 of appliance plug 112 are rigid contacts having a rectangular cross-section with a chamfered tip, and also are equipped with small transverse holes or bores 128 near the ends of the blades. Holes 128 provide a small reduction in materials during manufacturing of the blades, and in addition a small padlock or tie can be passed through the blades to physically seal or prevent immediate use of the plug. As illustrated in FIGS. 12-14, the adapter plug 110 in an embodiment includes a clasping structure in one or both of female slots 122 and 123 of socket portion 118. Such clasping or locking structure, the details of which are discussed below includes a tab portion which is positioned and configured to extend into one of the holes 128 in blades 114 and 115 of plug 112 when the plug is inserted into socket portion 118 of the adapter plug 110. The clasping or locking structure provided several advantages, one of which is to prevent the blades 114 and 115 of plug 112 from inadvertently becoming disconnected from the adapter plug 110. Since two-pronged plugs such as plug 112 cannot be used with the safety outlet without an adapter plug 110, maintaining an adapter plug 112 connected to such two-pronged power cord plugs is beneficial since the appliance connected to the plug by a power cord will be ready for immediate use with the safety outlet. Appliances having three-pronged plugs do not require use of an adapter plug 110 since the standard grounding prong will activate the switching mechanism of the present inventor's safety outlet or switch upon being inserted in the grounding pin slot of the safety outlet. In addition, when it is desired to remove the plug 112 from the safety outlet, the adapter 110 should not be left in the outlet as this will override the advantages of the present inventor's safety outlet, namely that as discussed above an electrical connection is not established unless a ground prong or another suitable contact such as activator pin 126 is completely inserted in the ground prong aperture of the safety outlet. Securing the plug 112 to the adapter 110 will prevent this from occurring and the safety aspect of the inventor's outlet will not be overridden particularly by consumers who may not appreciate or even have knowledge of the safety outlet.

Referring still to FIG. 12, which is a partially cutaway side view showing further details of the adapter plug 110 of the invention, adapter blade or pin 126 is secured preferably by molding within an elongated first cavity 130 in body 116 of plug 110 projecting endwise outwardly from end face 121. Adapter pin 126 is not in electrical contact with any terminals or connectors within body 116, does not connect an appliance to ground, and as indicated above is provided solely to activate a switch in the ground prong opening in the safety outlet or receptacle so that two-prong plugs can be utilized with the safety outlet or receptacle. Neutral blade 124 and hot blade 125 are similarly molded in separate laterally spaced cavities 132 and 133 (FIG. 14) in body 116 with parallel blades 124 and 125 also projecting endwise outwardly from end face 121 and with together with pin 126 forming plug portion 120.

Outwardly opening slots 122 and 123 in end surface 119 of body 116 serve as entrances into cavities 132 and 133 molded in body 116. In the illustrated embodiment, as best shown in FIG. 14, blades 124 and 125 are of a folded type, and the inner ends of blades 124 and 125 extend into and are secured in cavities 132 and 133. More particularly, the inner ends of blades 124 and 125 are forked, and are identified in FIG. 14 as pairs of forked ends 134*a-b* and 135*a-b*, respectively. Forked ends 134*a-b* and 135-*ab* are cooperatively positioned in cavities 132 and 133 such that when the outwardly projecting blades 114 and 115 of plug 112 are inserted through slots 122 and 123 into cavities 132 and 133, respectively, the blades extend between and push apart the pairs of forked ends 134*a-b* and 135*a-b*, respectively, which are configured to be continually urged inwardly into contact with the side surfaces of the blades 114 and 115, establishing a tight electrical connection. In addition, the pairs of forked ends 134*a-b* and 135*a-b* are provided with a cutout 136 forming an inwardly directed tab 138 extending towards the opposite forked end pair. Tabs 138 are inclined or angled so that as the plug blades 114 and 115 are inserted in slots 122 and 123 of socket 118, the pairs of tabs 138 are forced outwardly away from each other, and are dimensioned to fit in holes 128 on the outer ends of blades 114 and 115. Thus, when blades 114 and 115 are completely inserted in slots 122 and 123, as shown in FIG. 13 the tabs 138 will automatically enter and press into holes 128. The tabs 138 also are configured have a sharp rear edge which will prevent the tabs 138 from becoming disengaged from hole 128 when a manual pulling force on the plug 112 is applied.

The adapter plug 110 is thusly prevented from being easily removed from plug 112 such that the appliance attached to plug 112 by a power cord is ready for immediate use with the present inventor's safety outlet or receptacle. In addition, when it is desired to unplug the power cord from the outlet, adapter plug 110 will not be retained in the outlet accidentally or otherwise, which would overcome the safety features of the outlet by causing electrical connection to remain on even when no appliance is plugged into the outlet. In another embodiment, the safety outlet may be modified to detect whether a three-pronged grounding plug or an adapter 110 is inserted into the outlet, and in addition in the event that adapter 110 is used whether or not an appliance is connected to the adapter, in which case the electrical circuit could be switched to a deactivated condition. Adapter plug 110 will also still work with both conventional NEMA 1-15R and NEMA 5-15R receptacles. In other embodiments, adapter plug 110 may be colored or otherwise marked to indicate that it is a "non-grounding" plug even though plug portion 120 includes a pin 126 which extends into the grounding pin receiving slot of an outlet or receptacle. In other embodiments, where the blades 124 and 125 of adapter 110 are not of a folded type, a separate tab structure that is inserted into the holes 128 one or both of the plug blades may be provided.

While the present invention has been illustrated with respect to a standard 15-amp, 125-volt AC electricity North American duplex receptacle, the present inventor's ground prong power switch mechanism and adapter may also be customized for use with plugs and receptacles having different voltage and amperage ratings, contact blade widths, shapes, orientations, and dimensional standards, both in the United States and other countries. According to standards set by NEMA different, unique and non-interchangeable connectors are required for each combination of voltage, current carrying capacity, and grounding system. Common connectors may have a current rating from 15 to 60-amps and voltage ratings from 125 to 600-volts, may have a straight or curved blade, and may be non-locking or twist-locking connectors which are used for heavy industrial and commercial equipment to protect against accidental disconnection. Most if not all higher voltage and amperage connectors require that the appliance have a grounding plug, and therefore are immediately suited for use with the present inventor's ground prong power switch mechanism, the electrically conductive components of which also will be modified to match the ratings of the particular receptacle outlet device. The adapter plug could also be adapted for use with any that do not already have a grounding prong in order to activate the switch mechanism of the present inventor's safety outlet.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. As used throughout, ranges are used as shorthand for describing each and every value that is within the range. Any value within the range can be selected as the terminus of the range. In addition, all references cited herein are hereby incorporated by referenced in their entireties. In the event of a conflict in a definition in the present disclosure and that of a cited reference, the present disclosure controls.

I claim:

1. A power switch for an electrical receptacle comprising:

an insulative housing to be attached to the electrical receptacle, said receptacle having a plurality of blade-receiving slots each having an open end and a distal end, a first electrical terminal retained to the housing and configured for connecting to a phase conductor, and a second electrical terminal retained to the housing and configured for connecting to a conductor extending between the second electrical terminal and a phase or "hot" terminal of the electrical receptacle, a first electrical conductor retained in the housing, the first conductor electrically connected to the first electrical terminal, and having an electrical contacting member secured to a surface of the first conductor, a second electrical conductor retained in the housing, the second conductor electrically connected to the second electrical terminal and insulated from the first electrical conductor, and having an electrical contacting member connected to a surface of the second electrical conductor, the first and second conductors being retained in the housing such that the first conductor can flex between a first position in which the electrical contacting members on the first and second conductors are not in electrical contact and a second position in which the electrical contacting members on the first and second conductors are in electrical contact, and a push point mounted to the second electrical conductor having a shaft section extending outwardly from the second conductor, said shaft section dimensioned and configured to extend into the distal end of one of the blade receiving slots of the electrical receptacle a distance such that when a plug blade is substantially fully inserted in the slot the blade will press against the shaft section of the push point and cause the second conductor to move to the second position allowing electrical current to pass between the first terminal and the second terminal.

2. The power switch of claim 1 in which the push point additionally comprises a sleeve section connected to the second electrical conductor, and the shaft section of the push point having an outwardly tapered tip extending from a support section.

3. The power switch of claim 2 in which the shaft section has a conical shape.

4. The power switch of claim 2 in which the shaft section has a pyramid shape.

5. The power switch of claim 2 in which the tip of the shaft section is dimensioned to be received in an open outer end of a plug blade.

6. The power switch of claim 2 in which the first electrical conductor additionally comprises a first branch and a second branch, each of the first and second branches having an electrical contact member on a surface thereof, said first branch and second electrical conductor retained in the housing such that the second conductor can flex between a first position in which the electrical contacts on the first branch and second conductor are not in electrical contact and a second position in which the electrical contacts on the first branch and second conductor are in electrical contact, and additionally comprising a third electrical terminal retained to the housing and configured for connecting a conductor between the third electrical terminal and another phase terminal of the receptacle, and a third conductor retained in the housing and connected to the third terminal, the third conductor having an electrical contacting member connected to a surface of the third conductor, and another push point mounted to the third conductor, said second branch and third electrical conductor retained in the housing such that the third conductor can flex between a first position in which the electrical contacts on the second branch and third conductor are not in electrical contact and a second position in which the electrical contacts on the second branch and third conductor are in electrical contact, said push point on the third conductor having a shaft section extending outwardly in a direction opposite the electrical contacting member on the third conductor and retained on the third conductor in a position so as to extend into the distal end of a blade receiving slot of another outlet of the electrical receptacle.

7. The power switch of claim 6 in which the push points mounted to the second and third conductors are dimensioned and located on the conductors in a position configured to extend into the distal end of a ground blade receiving slot of the electrical receptacle.

8. The power switch of claim 7 which is configured to be secured along a rear side of a base member of the electrical receptacle.

9. The power switch of claim 8 in which the push points are configured to extend through apertures in a ground prong mounting strap retained in the receptacle into the distal end of the ground prong receiving slots.

10. The power switch of claim 9 in which the push points are configured to extend through apertures in the rear side of the base member aligned with apertures in the ground prong mounting strap.

11. The power switch of claim 1 which is rated for use with 15A-30A 125V electrical receptacle devices.

12. The power switch of claim 1 is in an open circuit position when no plug blade is substantially completely inserted in the blade receiving slot in which a push point extends.

13. The power switch of claim 12 in which said push point has a reduced area outer end which will deflect to a side of the blade receiving slot and not cause the switch to move into a closed circuit position in the event an implement other than a plug blade is inserted into the slot.

14. The power switch of claim 12 in which electrical current is not provided to the electrical receptacle unless a blade is inserted in the blade receiving slot containing the push point.

15. The power switch of claim 12 in which an electrical current will be provided to the electrical receptacle only when the push point is depressed a sufficient distance to cause the second conductor to move to the second position.

16. The power switch of claim 12 is configurable for use with receptacles having different voltage and amperage ratings.

17. The power switch of claim 12 is configurable for use with a two-phase or three-phase electrical supply.

18. The power switch of claim 12 wherein the push point is positioned to extend into the distal end of one of the blade receiving slots configured to receive a ground prong or blade.

* * * * *